US009449560B2

(12) United States Patent
Oh et al.

(10) Patent No.: US 9,449,560 B2
(45) Date of Patent: Sep. 20, 2016

(54) ORGANIC LIGHT EMITTING DISPLAY FOR SENSING DEGRADATION OF ORGANIC LIGHT EMITTING DIODE

(71) Applicant: LG Display Co., Ltd., Seoul (KR)

(72) Inventors: Hyemi Oh, Gwangju (KR); Hunki Shin, Gyeonggi-do (KR); Changhee Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 25 days.

(21) Appl. No.: 14/584,214

(22) Filed: Dec. 29, 2014

(65) Prior Publication Data

US 2016/0012798 A1 Jan. 14, 2016

(30) Foreign Application Priority Data

Jul. 10, 2014 (KR) ..... 10-2014-0086901

(51) Int. Cl.
*G09G 5/00* (2006.01)
*G09G 3/32* (2016.01)

(52) U.S. Cl.
CPC ..... *G09G 3/3291* (2013.01); *G09G 3/325* (2013.01); *G09G 3/3283* (2013.01); *G09G 2300/0426* (2013.01); *G09G 2300/0452* (2013.01); *G09G 2300/0465* (2013.01); *G09G 2300/0847* (2013.01); *G09G 2310/027* (2013.01); *G09G 2320/045* (2013.01)

(58) Field of Classification Search
CPC .. G09G 3/3208; G09G 3/325; G09G 3/3283; G09G 3/3291; G09G 2300/0847; G09G 2310/0278; G09G 2320/043; G09G 2320/045; G09G 2320/046
See application file for complete search history.

(56) References Cited

U.S. PATENT DOCUMENTS 7,619,597 B2 * 11/2009 Nathan ..... G09G 3/3233 315/169.3
2008/0088648 A1 * 4/2008 Nathan ..... G09G 3/3233 345/690
2008/0231562 A1 * 9/2008 Kwon ..... G09G 3/3233 345/77
2008/0252568 A1 * 10/2008 Kwon ..... G09G 3/3233 345/76
2009/0027377 A1 * 1/2009 Kwon ..... G09G 3/3233 345/214
2009/0184901 A1 * 7/2009 Kwon ..... G09G 3/3233 345/77
2011/0063283 A1 * 3/2011 Ryu ..... G09G 3/3283 345/214
2011/0074750 A1 * 3/2011 Leon ..... G09G 3/30 345/207
2011/0102418 A1 * 5/2011 Park ..... G09G 3/3233 345/214
2011/0122119 A1 * 5/2011 Bae ..... G09G 3/3233 345/211

(Continued)

*Primary Examiner* — Joe H Cheng
(74) *Attorney, Agent, or Firm* — Morgan, Lewis & Bockius LLP

(57) ABSTRACT

An organic light emitting display includes a display panel including a plurality of pixels, each of the plurality of pixels including an organic light emitting diode (OLED) and a driving thin film transistor (TFT) to control an emission amount of the OLED, the plurality of pixels connected to respective sensing lines; and at least one sensing unit connected to a corresponding one of the pixels through the respective sensing line, the at least one sensing unit configured to sense an amount of carriers accumulated in a parasitic capacitor of the OLED of the corresponding one of the pixels when a driving current flows in the OLED, the at least one sensing unit thereby sensing a degradation of the OLED.

14 Claims, 19 Drawing Sheets

(56) References Cited

U.S. PATENT DOCUMENTS

2011/0205250 A1* 8/2011 Yoo ..... G09G 3/3233 345/690
2011/0227505 A1* 9/2011 Park ..... H05B 33/0896 315/297
2012/0293478 A1* 11/2012 Chaji ..... G09G 3/3258 345/212
2013/0162617 A1* 6/2013 Yoon ..... G09G 3/3291 345/211
2014/0152642 A1* 6/2014 Kim ..... G09G 3/3233 345/212
2014/0152705 A1* 6/2014 Kwon ..... G09G 3/3275 345/690
2014/0204071 A1* 7/2014 Kwon ..... G09G 3/3291 345/212
2014/0333680 A1* 11/2014 Choi ..... G09G 3/3233 345/690
2014/0368489 A1* 12/2014 Pak ..... G09G 3/3233 345/212
2015/0029171 A1* 1/2015 Jo ..... G09G 3/3258 345/212
2015/0138177 A1* 5/2015 Kwon ..... G09G 3/3233 345/211
2015/0179105 A1* 6/2015 Mizukoshi ..... G09G 3/3266 345/76
2016/0071445 A1* 3/2016 Kim ..... G09G 3/006 345/212

* cited by examiner

| OLED Vth | Case1 | Case2 | Case3 | Case4 |
|---|---|---|---|---|
| R | 0V | +2V | 0V | +2V |
| W | 0V | +2V | 0V | +2V |
| G | 0V | +2V | 0V | +2V |
| B | 0V | 0V | +2V | +2V |

ORGANIC LIGHT EMITTING DISPLAY FOR SENSING DEGRADATION OF ORGANIC LIGHT EMITTING DIODE

This application claims the benefit of Korean Patent Application No. 10-2014-0086901 filed in Korea on Jul. 10, 2014, which is incorporated herein by reference for all purposes as if fully set forth herein.

BACKGROUND OF THE INVENTION

1. Field of the Invention

Embodiments of the invention relate to an organic light emitting display and more particularly to an organic light emitting display capable of sensing degradation of an organic light emitting diode.

2. Discussion of the Related Art

An active matrix organic light emitting display includes organic light emitting diodes (OLEDs) capable of emitting light by themselves, and bears advantages such as a fast response time, a high light emitting efficiency, a high luminance, a wide viewing angle, and the like.

The OLED serving as a self-emitting element generally includes an anode electrode, a cathode electrode, and an organic compound layer formed between the anode electrode and the cathode electrode. The organic compound layer may include a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL may move to the emission layer EML and form excitons. As a result, the emission layer EML generates visible light.

The organic light emitting display may arrange pixels, each including an OLED, in a matrix form and adjust a luminance of the pixels depending on grayscale of video data. Each pixel may include a driving thin film transistor (TFT) which controls a driving current flowing in the OLED depending on a gate-to-source voltage Vgs between a gate electrode and a source electrode of the driving TFT. A display grayscale (e.g., a display luminance) may be adjusted by an emission amount of the OLED proportional to a magnitude of the driving current.

The OLED may generally have a degradation characteristic of an increase in an operating point voltage (e.g., a threshold voltage) of the OLED and a reduction in an emission efficiency as an emission time of the OLED passes. Because an accumulated value of currents applied to the OLED of each pixel may be proportional to an accumulated value of gray levels represented in each pixel, the OLEDs of the pixels may have different degradation degrees. A degradation deviation between the OLEDs of the pixels results in a luminance deviation, and an image sticking phenomenon may be generated by an increase in the luminance deviation.

A related art compensation method for sensing the degradation of the OLED and then modulating video data based on a sensing value using an external circuit is proposed to compensate for the degradation of the OLED. In the related art compensation method, a data driving circuit directly receives a sensing voltage from each pixel through a sensing line and converts the sensing voltage into a digital sensing value. The data driving circuit then transmits the digital sensing value to a timing controller. Further, the timing controller modulates digital video data based on the digital sensing value and compensates for the degradation deviation of the OLED.

The related art compensation method has problems. The related art compensation method adopts a voltage sensing method to sense the degradation degree of the OLED. For example, the related art compensation method stores an anode voltage of the OLED in a parasitic capacitor of the sensing line and then senses the stored anode voltage of the OLED. In this instance, because a parasitic capacitance of the sensing line is very large, for example, several hundreds to several thousands of picofarads (pF), the time required in a sensing operation necessarily increases. For example, when the parasitic capacitance of the sensing line is large, it takes much time to charge the parasitic capacitor at a voltage level capable of being sensed. The problem is more serious in the sensing operation of a low gray level than a high gray level.

Further, the parasitic capacitance of the sensing line may vary depending on design conditions of the display panel affected by data lines adjacent to the sensing lines. When the sensing lines have different parasitic capacitances as described above, it may be difficult to obtain an accurate sensing value.

SUMMARY OF THE INVENTION

Embodiments of the invention provide an organic light emitting display capable of reducing a sensing time and improving the sensing reliability when sensing degradation of an organic light emitting diode.

In one aspect, an organic light emitting display includes a display panel having a plurality of pixels, each of the plurality of pixels including an organic light emitting diode (OLED) and a driving thin film transistor (TFT) to control an emission amount of the OLED, the plurality of pixels connected to respective sensing lines; and at least one sensing unit connected to a corresponding one of the pixels through the respective sensing line, the at least one sensing unit configured to sense an amount of carriers accumulated in a parasitic capacitor of the OLED of the corresponding one of the pixels when a driving current flows in the OLED, the at least one sensing unit thereby sensing a degradation of the OLED.

In another aspect, a method of forming an organic light emitting display includes forming a display panel including a plurality of pixels, each of the plurality of pixels including an organic light emitting diode (OLED) and a driving thin film transistor (TFT) to control an emission amount of the OLED, the plurality of pixels connected to respective sensing lines; and forming at least one sensing unit connected to a corresponding one of the pixels through the respective sensing line, the at least one sensing unit configured to sense an amount of carriers accumulated in a parasitic capacitor of the OLED of the corresponding one of the pixels when a driving current flows in the OLED the at least one sensing unit thereby sensing a degradation of the OLED.

It is to be understood that both the foregoing general description and the following detailed description are for example and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of embodiments of the invention. In the drawings.

DETAILED DESCRIPTION OF THE ILLUSTRATED EMBODIMENTS

Reference will now be made in detail to embodiments of the invention, examples of which are illustrated in the accompanying drawings. Where possible, the same or similar reference numbers may be used throughout the drawings to refer to the same or similar parts. Detailed description of known art may be omitted if such description may detract from the embodiments of the invention.

[Organic light emitting display including a sensing unit of a current sensing method]

Figure 1:
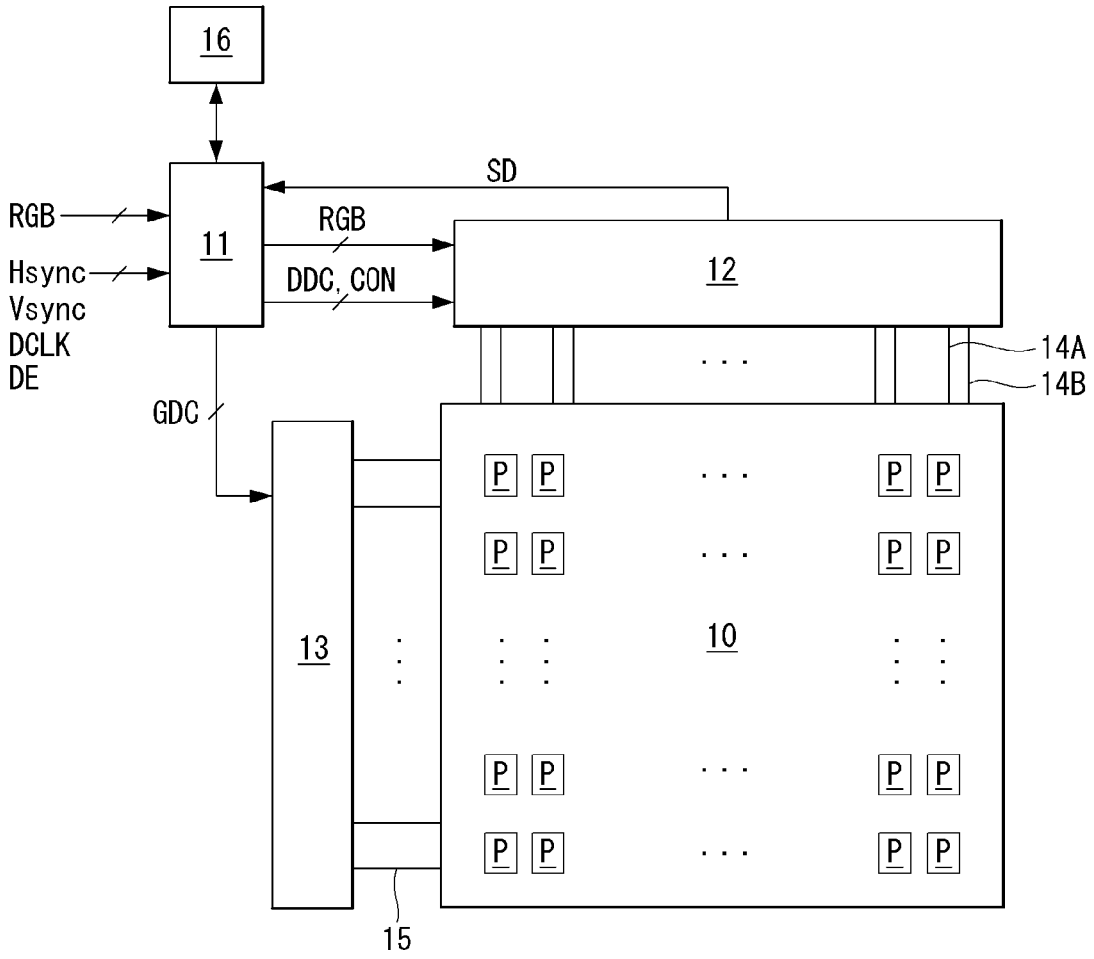
FIG. 1 shows an example organic light emitting display including a sensing unit according to an example embodiment of the invention.
Figure 2A:
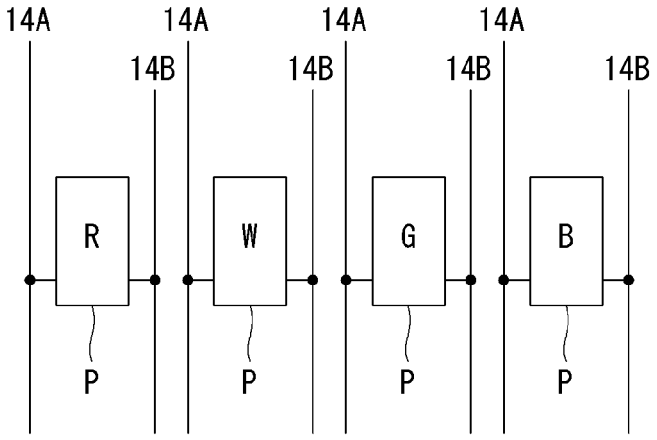
FIGS. 2A and 2B show an example of the connection of sensing lines and pixels.
Figure 2B:
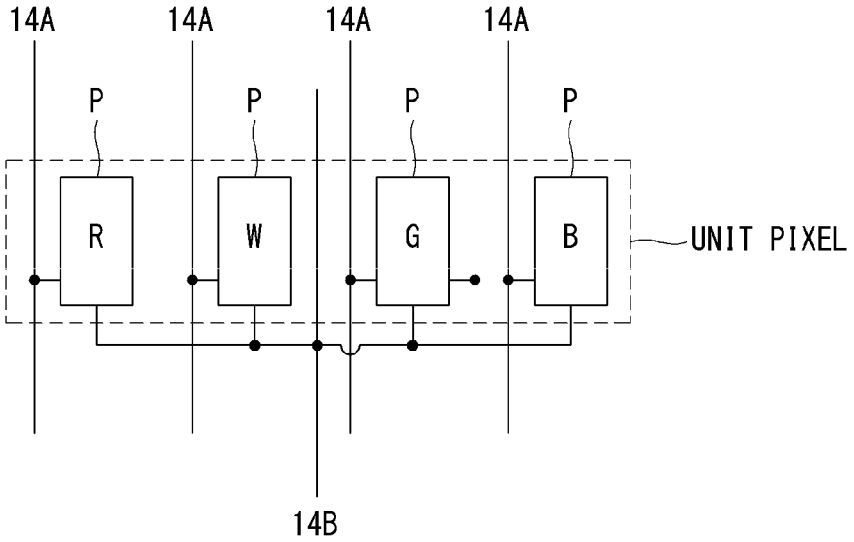
Figure 3:
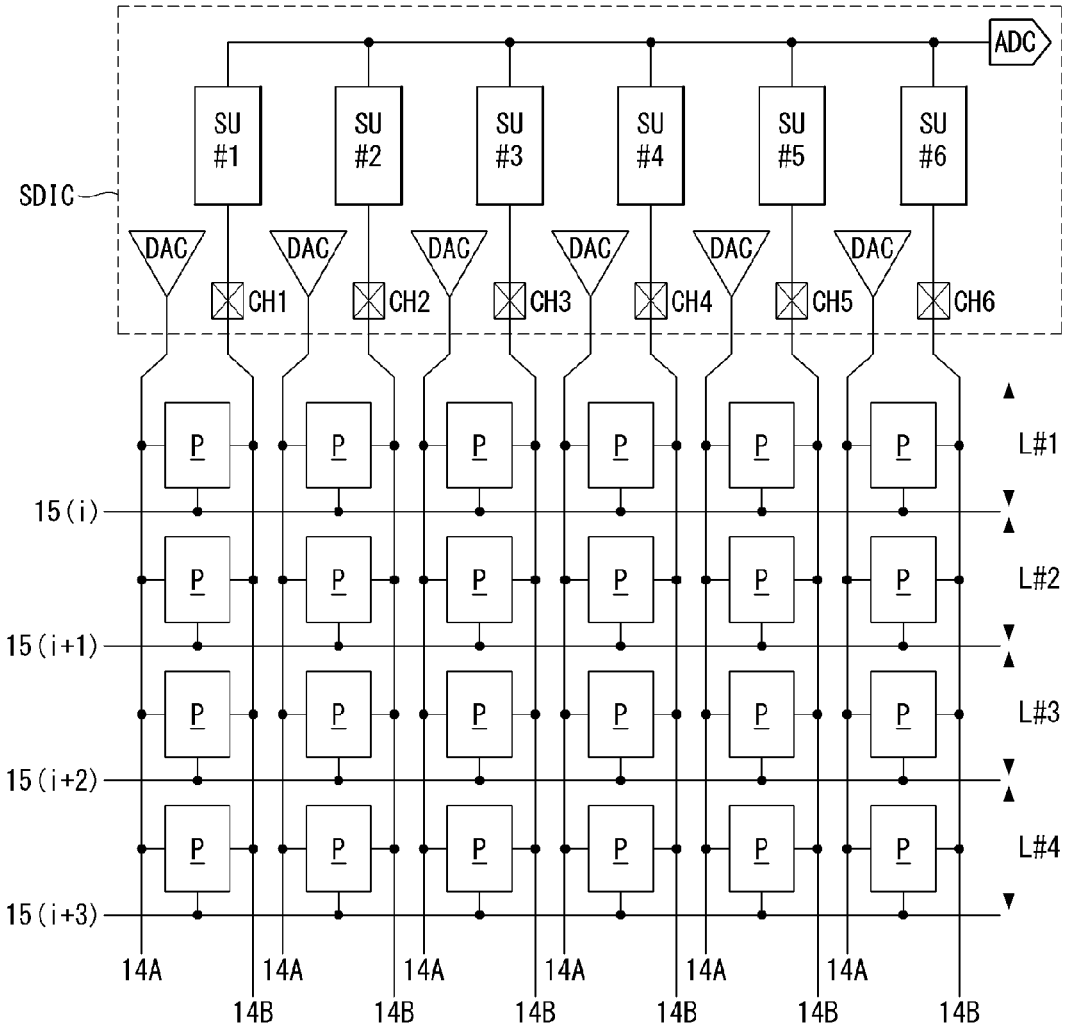
FIGS. 3 and 4 show an example configuration of a pixel array for implementing a current sensing method and a data driver integrated circuit (IC)
Figure 4:
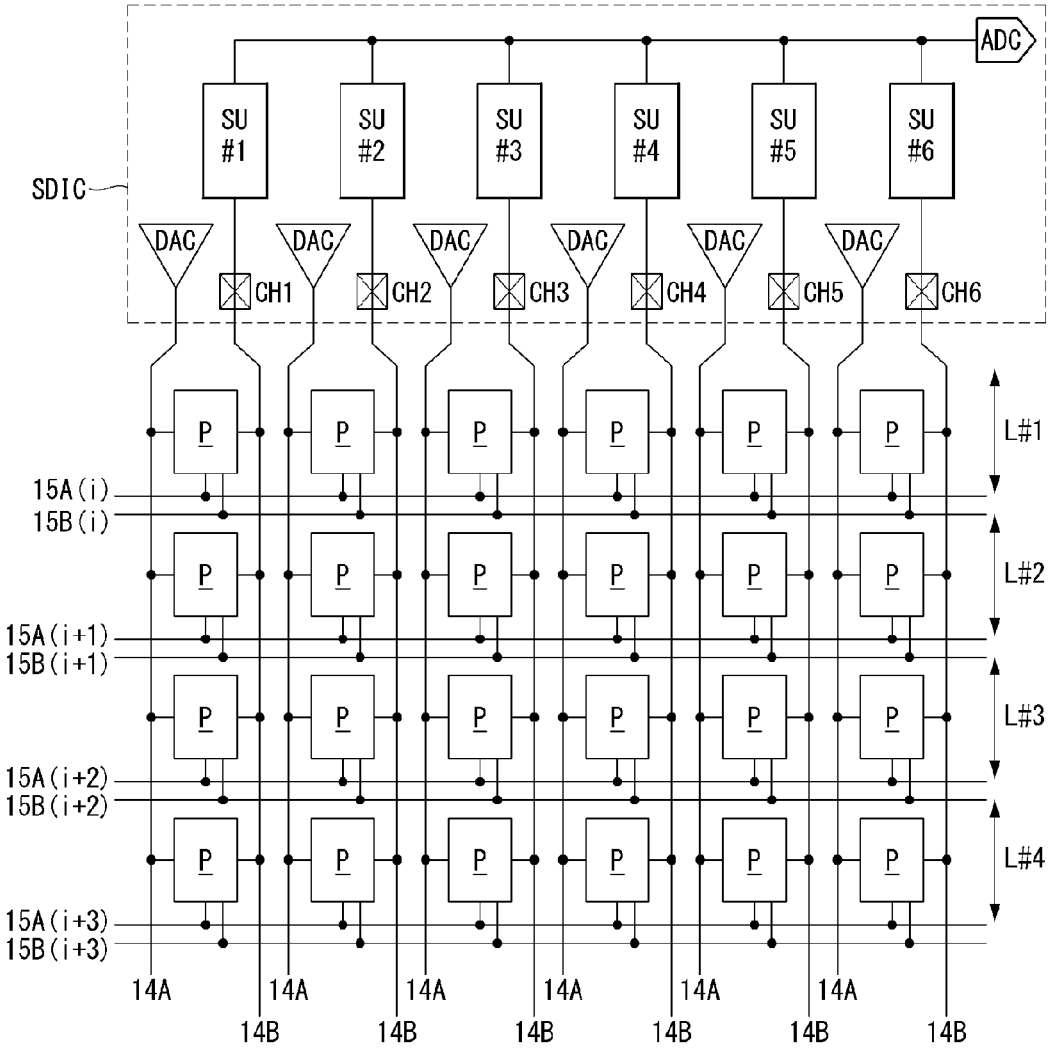

FIG. 1 shows an organic light emitting display including a sensing unit according to an example embodiment of the invention. FIGS. 2A and 2B show an example of the connection of sensing lines and pixels. FIGS. 3 and 4 show configuration of a pixel array for implementing a current sensing method and a data driver integrated circuit (IC).

As shown in FIGS. 1 to 4, an organic light emitting display according to embodiments of the invention may include a display panel 10, a timing controller 11, a data driving circuit 12, a gate driving circuit 13, and a memory 16.

The display panel 10 may include a plurality of data lines 14A, a plurality of sensing lines 14B, a plurality of gate lines 15 crossing the data lines 14A and the sensing lines 14B, and pixels P respectively arranged at crossings of the data, sensing, and gate lines 14A, 14B, and 15 in a matrix form.

As shown in FIGS. 2A and 2B, the pixels P may include a red (R) pixel for red display, a white (W) pixel for white display, a green (G) pixel for green display, and a blue (B) pixel for blue display, which may be adjacent to one another in a horizontal direction. Each pixel P may be connected to one of the plurality of data lines 14A, one of the plurality of sensing lines 14B, and one of the plurality of gate lines 15. Each pixel P may be electrically connected to the data line 14A in response to a gate pulse input through the gate line 15. Hence, each pixel P receives a data voltage from the data line 14A and outputs a sensing signal through the sensing line 14B.

As shown in FIGS. 2A and 3, the sensing lines 14B may be respectively connected to the horizontally adjacent pixels. For example, the horizontally adjacent R, W, G, and B pixels may be respectively connected to different sensing lines 14B. As shown in FIGS. 2B and 4, one sensing line 14B may be commonly connected to at least two horizontally adjacent pixels, so that an aperture ratio of the display panel 10 may be easily secured. For example, the horizontally adjacent R, W, G, and B pixels may share the same sensing line 14B with one another. One sensing line 14B may be assigned to each unit pixel (including the R, W, G, and B pixels).

Each pixel P may receive a high potential driving voltage EVDD and a low potential driving voltage EVSS from a power generator (not shown). Each pixel P according to embodiments of the invention may include an organic light emitting diode (OLED), a driving thin film transistor (TFT), first and second switch TFTs, and a storage capacitor for the external compensation. The TFTs constituting the pixel P may be implemented as p-type transistors or n-type transistors. Further, semiconductor layers of the TFTs constituting the pixel P may contain amorphous silicon, polycrystalline silicon, or oxide.

Each pixel P may differently operate in a normal drive for implementing a display image and a sensing drive for obtaining a sensing value. The sensing drive may be performed earlier than the normal drive for a predetermined period of time or may be performed in vertical blank periods during the normal drive.

The normal drive may be configured as one operation of the data driving circuit 12 and the gate driving circuit 13 under the control of the timing controller 11. The sensing drive may be configured as different operations of the data driving circuit 12 and the gate driving circuit 13 under the control of the timing controller 11. The timing controller 11 may perform an operation for obtaining compensation data for a deviation compensation based on the sensing result and an operation for modulating digital video data using the compensation data.

The data driving circuit 12 may include at least one data driver integrated circuit (IC) SDIC. The data driver IC SDIC may include a plurality of digital-to-analog converters (DACs) respectively connected to the data lines 14A and a plurality of sensing units SU#1 to SU#6 connected to the sensing lines 14B through sensing channels CH1 to CH6.

In the normal drive, the DACs of the data driver IC SDIC convert digital video data RGB into an image display data voltage in response to a data control signal DDC supplied from the timing controller 11 and supply the image display data voltage to the data lines 14A. In the sensing drive, the DACs of the data driver IC SDIC may generate a sensing data voltage in response to the data control signal DDC supplied from the timing controller 11 and may supply the sensing data voltage to the data lines 14A.

Each of the sensing units SU#1 to SU#6 of the data driver IC SDIC may sense current information (e.g., an amount of carriers accumulated in a parasitic capacitor of an OLED of a sensing target pixel P corresponding to a driving current) of the sensing target pixel P. Each of the sensing units SU#1 to SU#6 may be implemented as a current integrator (see, e.g., FIGS. 5 to 14B) and also may be implemented as a current comparator (see, e.g., FIG. 15). When each of the sensing units SU#1 to SU#6 is implemented as the current integrator, the data driver IC SDIC may further include an analog-to-digital converter (ADC) connected to output terminals of the sensing units SU#1 to SU#6. The data driver IC SDIC may perform digital processing on an analog sensing value and transmit the digital sensing value to the timing controller 11.

In the normal drive, the gate driving circuit 13 may generate an image display gate pulse based on a gate control signal GDC and then sequentially supplies the image display gate pulse to the gate lines 15 in a line sequential manner (in order of lines L#1, L#2, . . . ). In the sensing drive, the gate driving circuit 13 may generate a sensing gate pulse based on the gate control signal GDC and then sequentially supplies the sensing gate pulse to the gate lines 15 in the line sequential manner (in order of the lines L#1, L#2, . . . ). An on-pulse period of the sensing gate pulse may be wider than an on-pulse period of the image display gate pulse. The on-pulse period of the sensing gate pulse may correspond to a sensing-on time of one line. The sensing-on time of one line means a scan time allotted to simultaneously sense the pixels of one pixel line (L#1, L#2, . . . ).

The gate pulse may include a scan control signal SCAN and a sensing control signal SEN (see, e.g., FIGS. 3 to 9). The scan control signal SCAN and the sensing control signal SEN may be equally implemented (see, e.g., FIGS. 3, 5, and 7) or may be differently implemented (see, e.g., FIGS. 4, 6, 8, and 9). When the scan control signal SCAN and the sensing control signal SEN are equally implemented, the scan control signal SCAN and the sensing control signal SEN may be applied to each pixel P through the same gate line 15 in the same signal form. Hence, it may be effective in a reduction in the number of signal lines. On the other hand, when the scan control signal SCAN and the sensing control signal SEN are differently implemented, the scan control signal SCAN and the sensing control signal SEN may be applied to each pixel P through different gate lines 15A and 15B.

The timing controller 11 may generate the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. The timing controller 11 may separate the normal drive from the sensing drive based on a predetermined reference signal (for example, a driving power enable signal, the vertical sync signal Vsync, the data enable signal DE, etc.) and may generate the data control signal DDC and the gate control signal GDC in conformity with the normal drive and the sensing drive. Further, the timing controller 11 may further generate related switching control signals, so as to operate internal switches of the sensing units SU#1 to SU#6 in conformity with the normal drive and the sensing drive.

In the sensing drive, the timing controller 11 may transmit digital data corresponding to the sensing data voltage to the data driving circuit 12. In the sensing drive, the timing controller 11 may detect the degradation of the OLED of each pixel P based on a digital sensing value SD transmitted from the data driving circuit 12 and may store compensation data capable of compensating for a degradation deviation between the pixels P in the memory 16.

In the normal drive, the timing controller 11 may modulate the digital video data RGB for image implementation based on the compensation data stored in the memory 16 and then transmit the modulated digital video data RGB to the data driving circuit 12.

Embodiments of the invention may reduce the sensing time through the low current and high-speed sensing and increase the sensing accuracy through the current sensing method. As an example of the current sensing method, embodiments of the invention may install at least one sensing unit in the data driving circuit and sense an amount of carriers accumulated in the parasitic capacitor of the OLED of the sensing target pixel through the sensing unit when the driving current flows in the OLED of the sensing target pixel.

Figure 14A:
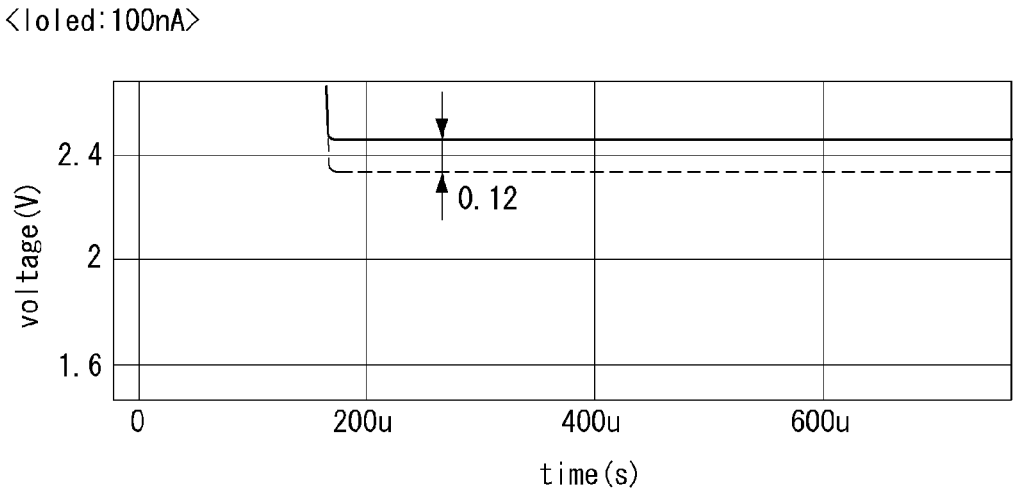
FIGS. 14A and 14B show that an example difference between sensing voltages before and after degradation of an OLED may vary depending on a magnitude of a driving current of the OLED.
Figure 14B:
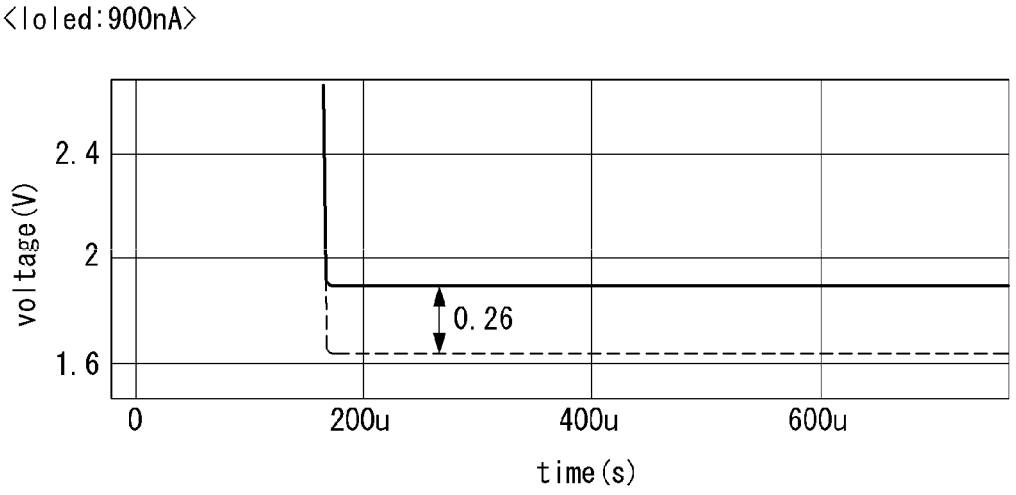
Figure 15:
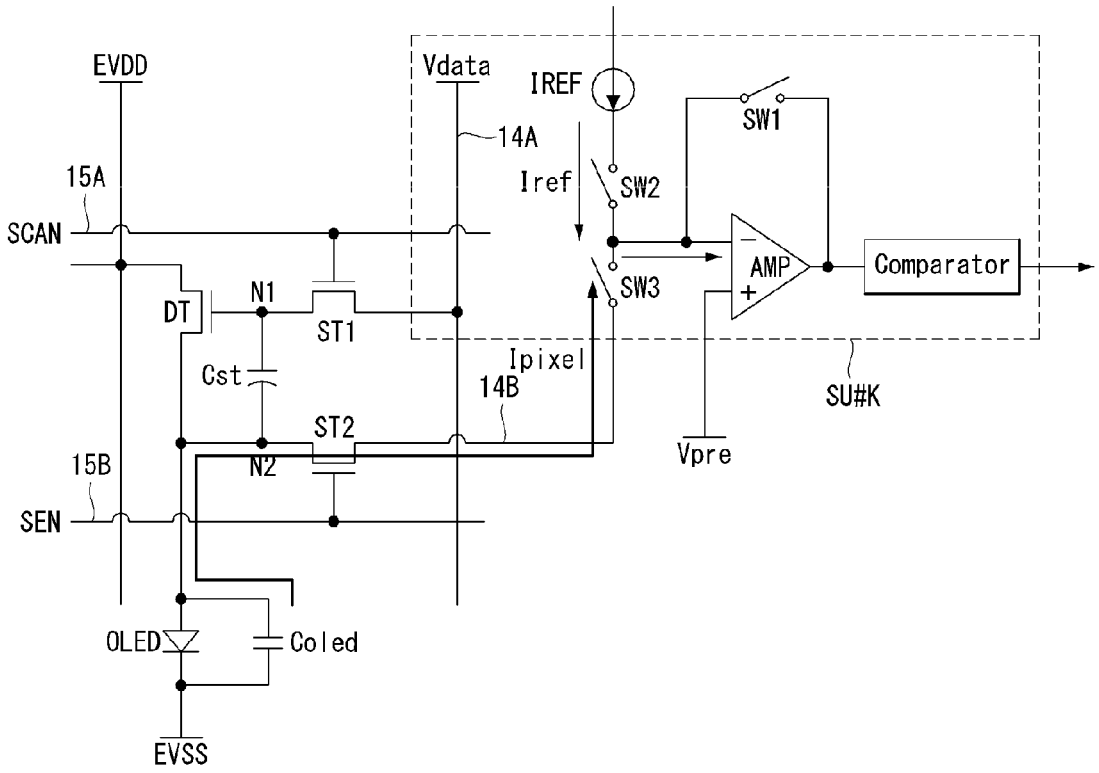
FIG. 15 shows an example connection structure between one pixel applied to external compensation of a current sensing method and a sensing unit including a current comparator.

Embodiments of the invention may use the current integrator shown by example in FIGS. 5 to 14 as the sensing unit, and also may use the current comparator shown in FIG. 15 as the sensing unit, so as to sense the amount of carriers accumulated in the parasitic capacitor of the OLED. Hereinafter, an example current sensing method is described in detail.

[Embodiment of a Current Sensing Method Using a Current Integrator]

Figure 5:
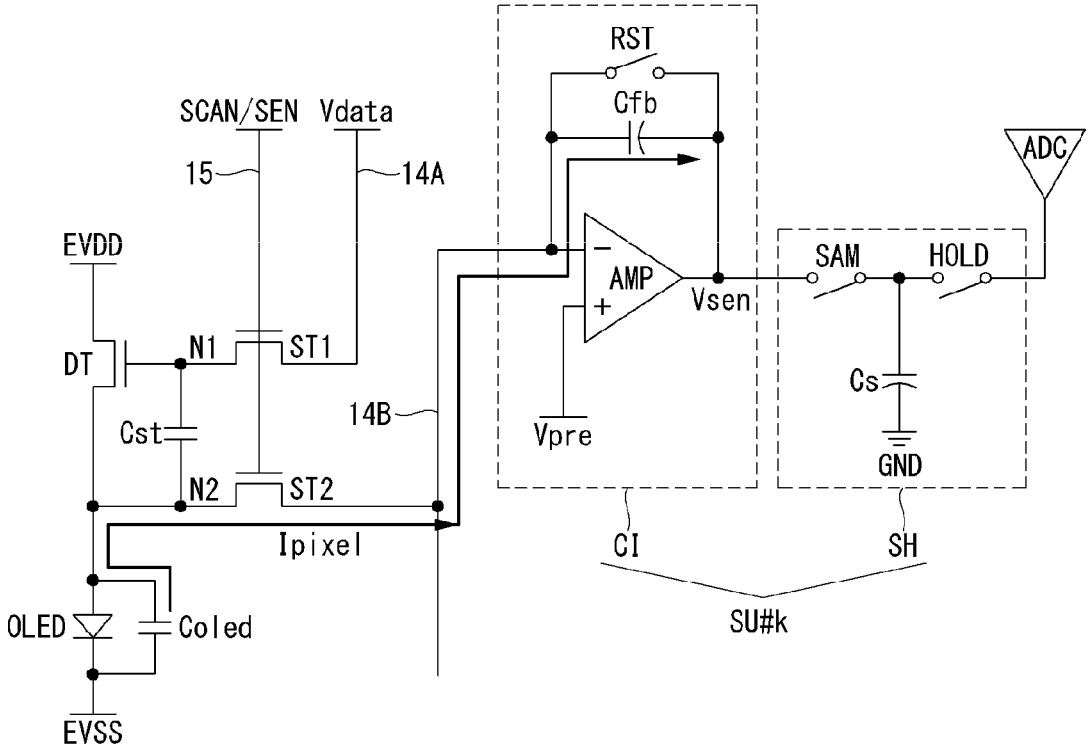
FIG. 5 shows an example connection structure between one pixel applied to external compensation of a current sensing method and a sensing unit including a current integrator.
Figure 6:
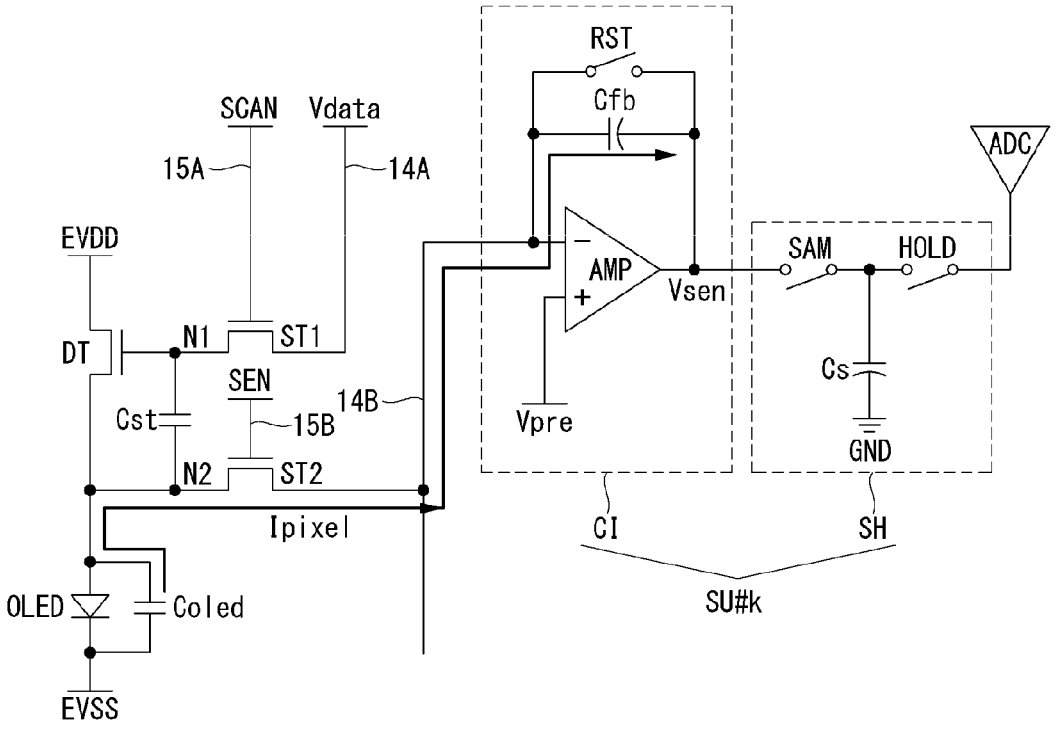
FIG. 6 shows another example connection structure between one pixel applied to external compensation of a current sensing method and a sensing unit including a current integrator.

FIG. 5 shows an example connection structure between one pixel applied to external compensation of the current sensing method and a sensing unit including a current integrator. FIG. 6 shows another example connection structure between one pixel applied to external compensation of the current sensing method and a sensing unit including a current integrator. For example, FIG. 5 shows the connection structure when the scan control signal SCAN and the sensing control signal SEN are equally implemented, and FIG. 6 shows the connection structure when the scan control signal SCAN and the sensing control signal SEN are differently implemented. The connection structures shown in FIGS. 5 and 6 may be substantially the same as each other in the remaining configuration except with respect to the scan control signal SCAN and the sensing control signal SEN.

As shown in FIGS. 5 and 6, each pixel P may include an OLED, a driving TFT DT, a storage capacitor Cst, a first switch TFT ST1, and a second switch TFT ST2.

The OLED may include an anode electrode connected to a second node N2, a cathode electrode connected to an input terminal of the low potential driving voltage EVSS, and an organic compound layer positioned between the anode electrode and the cathode electrode. A parasitic capacitor Coled may be generated in the OLED by the anode electrode, the cathode electrode, and a plurality of insulating layers existing between the anode electrode and the cathode electrode. A capacitance of the OLED parasitic capacitor Coled may be several picofarads (pF), and may be much less than a parasitic capacitance of several hundreds to several thousands of picofarads (pF) existing in the sensing line 14B. Embodiments of the invention use the OLED parasitic capacitor Coled for the current sensing.

The driving TFT DT may control an amount of a current input to the OLED depending on a gate-to-source voltage Vgs of the driving TFT DT. The driving TFT DT may include a gate electrode connected to a first node N1, a drain electrode connected to an input terminal of the high potential driving voltage EVDD, and a source electrode connected to the second node N2. The storage capacitor Cst may be connected between the first node N1 and the second node N2. The first switch TFT ST1 applies a data voltage Vdata on the data line 14A to the first node N1 in response to the scan control signal SCAN. The first switch TFT ST1 may include a gate electrode connected to the gate line 15 (FIG. 5) or first gate line 15A (FIG. 6), a drain electrode connected to the data line 14A, and a source electrode connected to the first node N1. The second switch TFT ST2 may turn on the flow of a current between the second node N2 and the sensing line 14B in response to the sensing control signal SEN. The second switch TFT ST2 may include a gate electrode connected to the gate line 15 (FIG. 5) or the second gate line 15B (FIG. 6), a drain electrode connected to the sensing line 14B, and a source electrode connected to the second source node N2.

A sensing unit SU#k connected to the pixel P may include a current integrator CI and a sample and hold unit SH, where k is a positive integer.

The current integrator CI may integrate current information Ipixel coming from the pixel P and may generate a sensing voltage Vsen. The current integrator CI may include an amplifier AMP, an integrating capacitor Cfb, and a reset switch RST connected to both terminals of the integrating capacitor Cfb. The amplifier AMP may include an inverting input terminal (−) which may be connected to the sensing line 14B through the sensing channel CH and receives the current information Ipixel of the pixel P (e.g., carriers charged to the OLED parasitic capacitor Coled of the pixel P) from the sensing line 14B, a non-inverting input terminal (+) receiving a reference voltage Vpre, and an output terminal The integrating capacitor Cfb may be connected between the inverting input terminal (−) and the output terminal of the amplifier AMP.

The current integrator CI may be connected to the ADC of the data driver IC SDIC through the sample and hold unit SH. The sample and hold unit SH may include a sampling switch SAM, which samples the sensing voltage Vsen output from the amplifier AMP and stores the sampled sensing voltage Vsen in a sampling capacitor Cs, and a holding switch HOLD for transferring the sensing voltage Vsen stored in the sampling capacitor Cs to the ADC.

Figure 7:
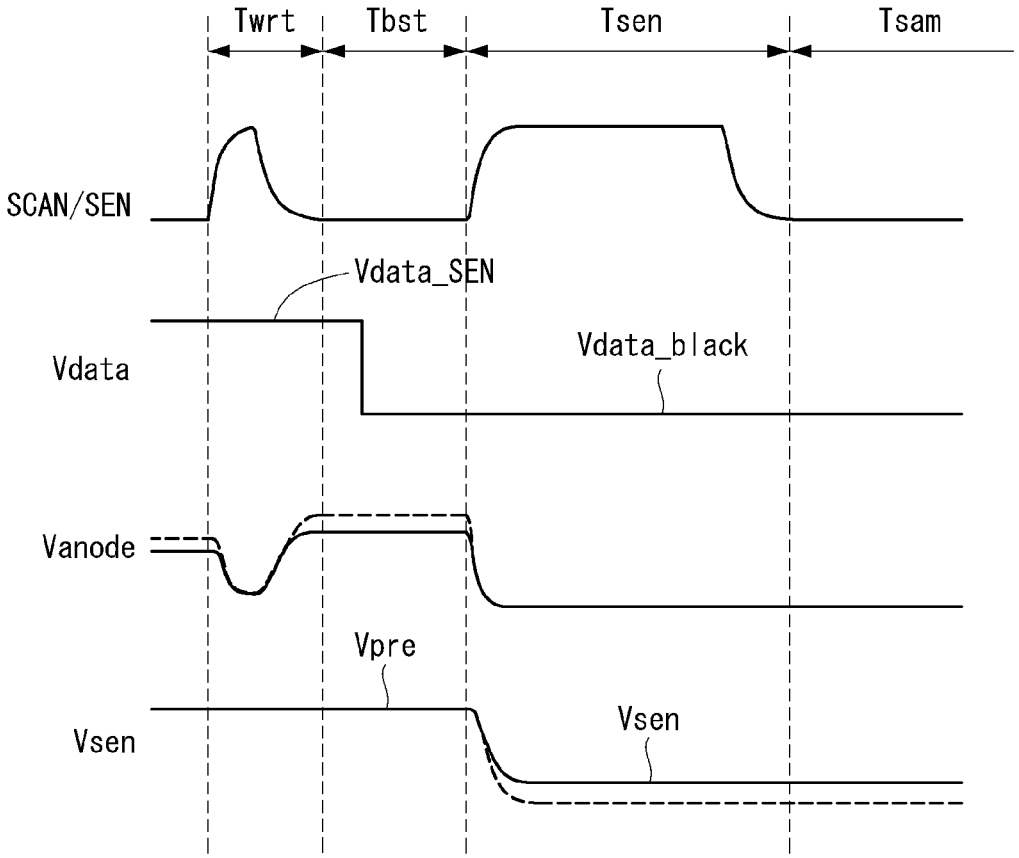
FIG. 7 shows an example degradation sensing timing of an organic light emitting diode (OLED) based on the connection structure shown in FIG. 5.
Figure 8:
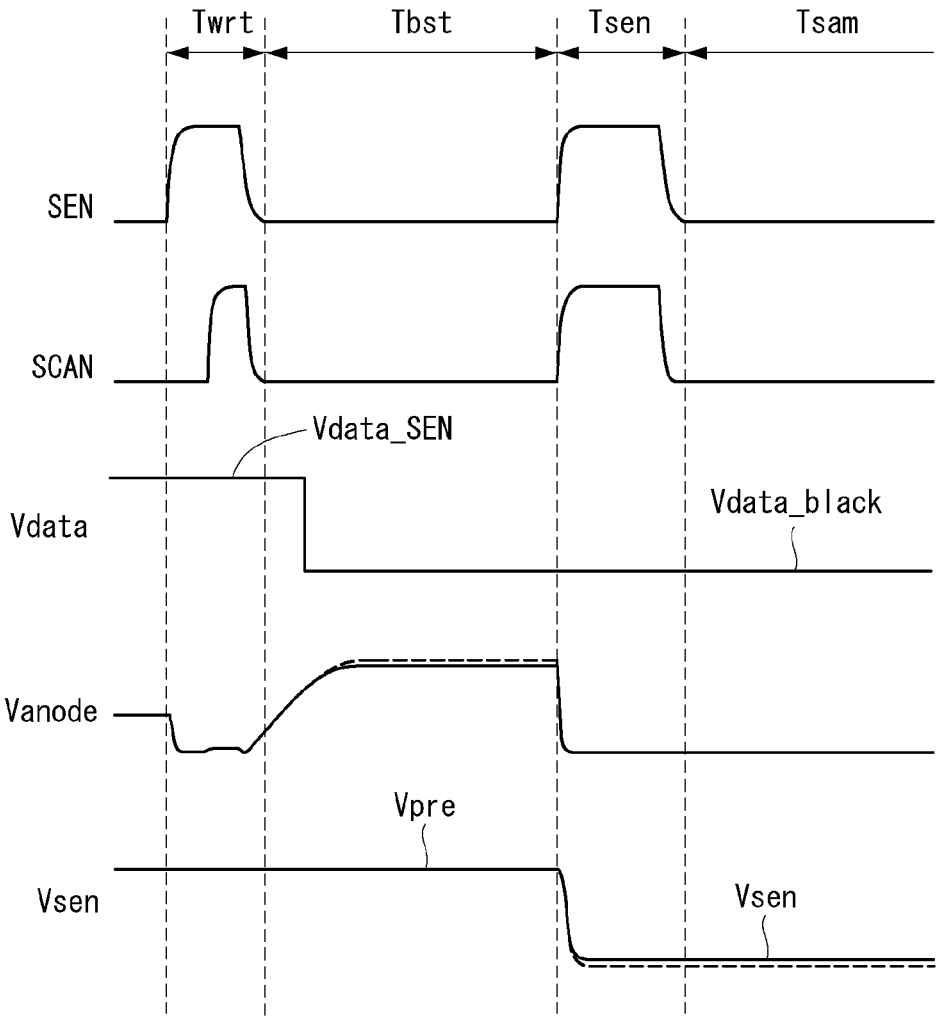
FIGS. 8 and 9 show example degradation sensing timings of an OLED based on the connection structure shown in FIG. 6.
Figure 9:
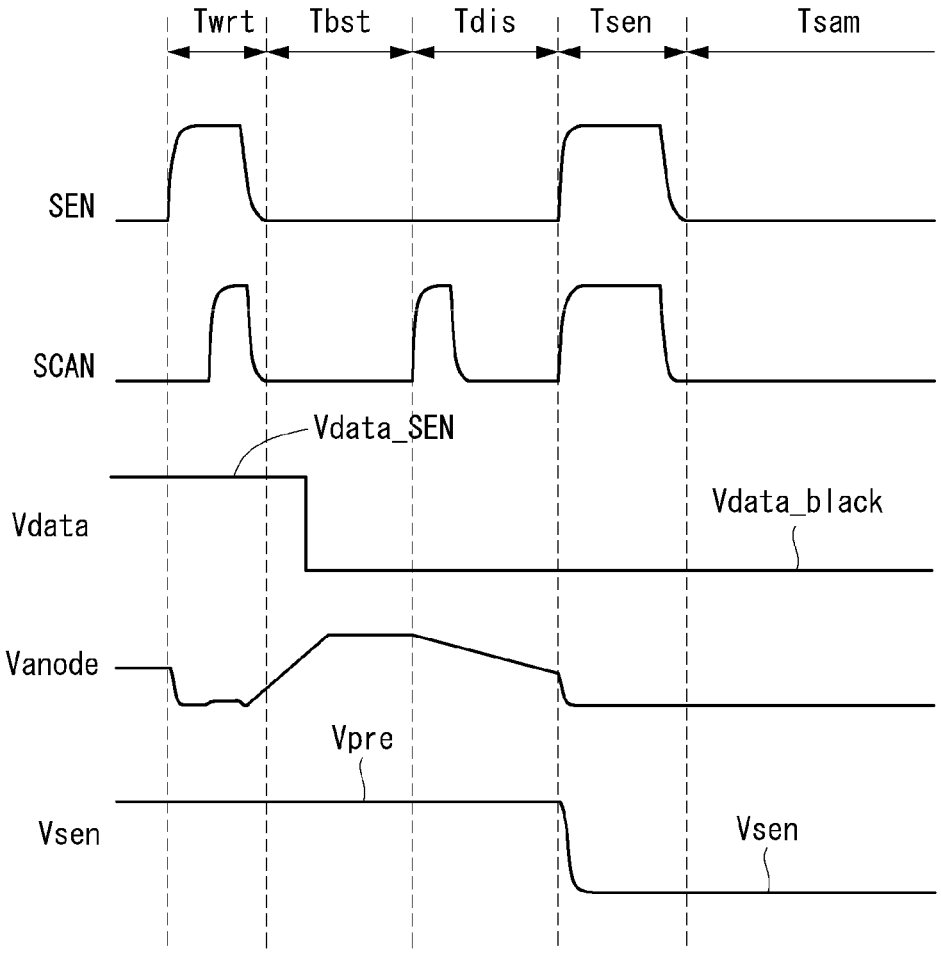
Figure 10A:
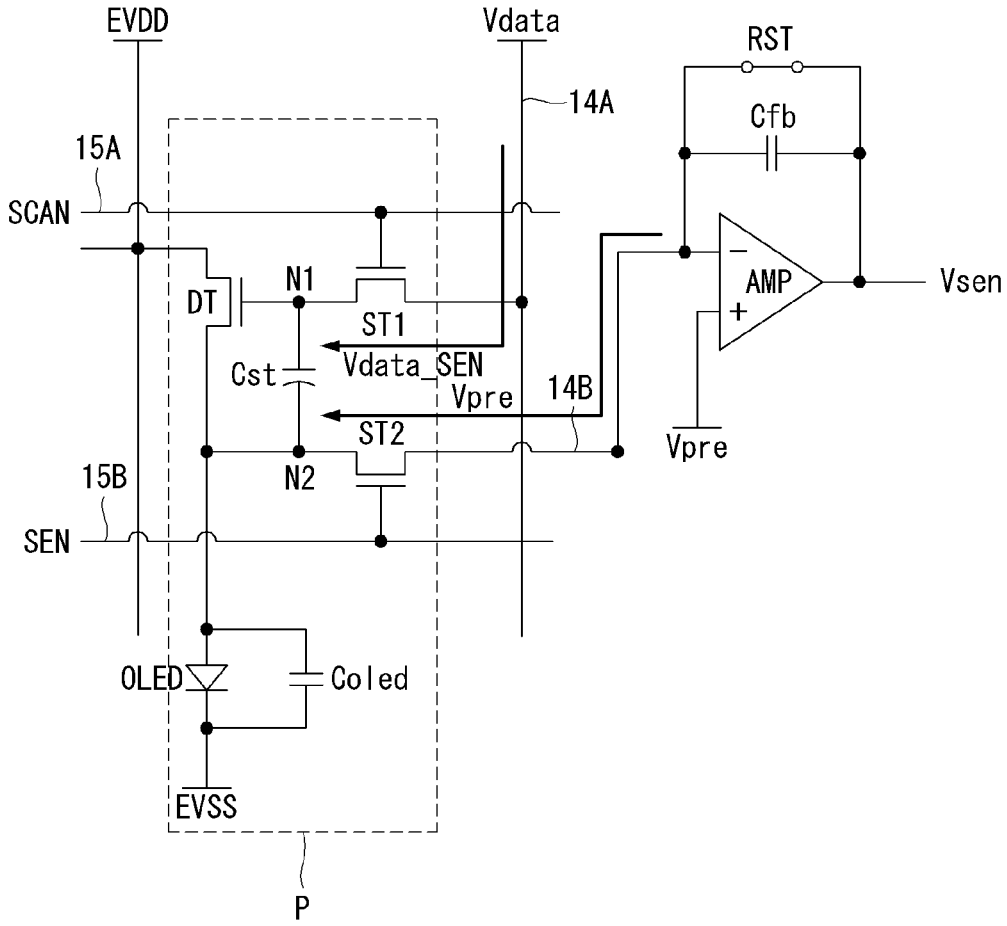
FIGS. 10A to 10C show an example operation state of a pixel and a current integrator in a data writing period, a boosting period, and a sensing period, which may be commonly included in FIGS. 7 to 9.
Figure 10B:
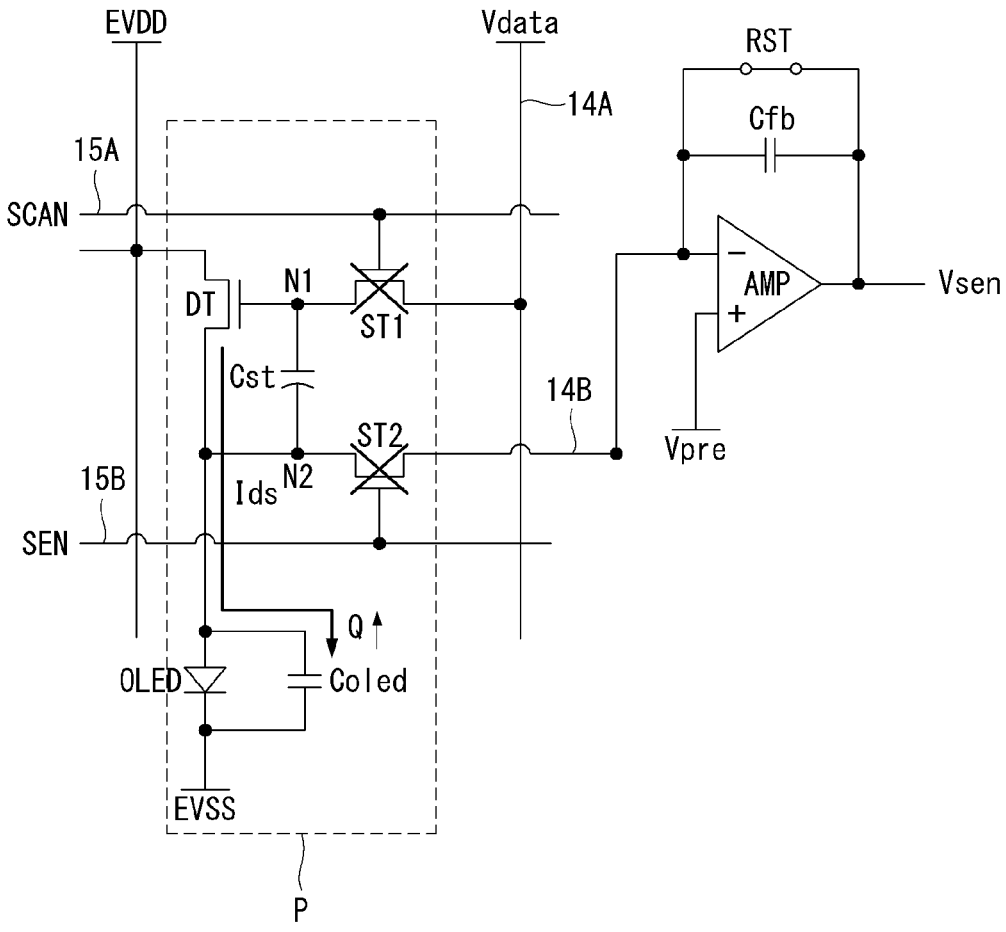
Figure 10C:
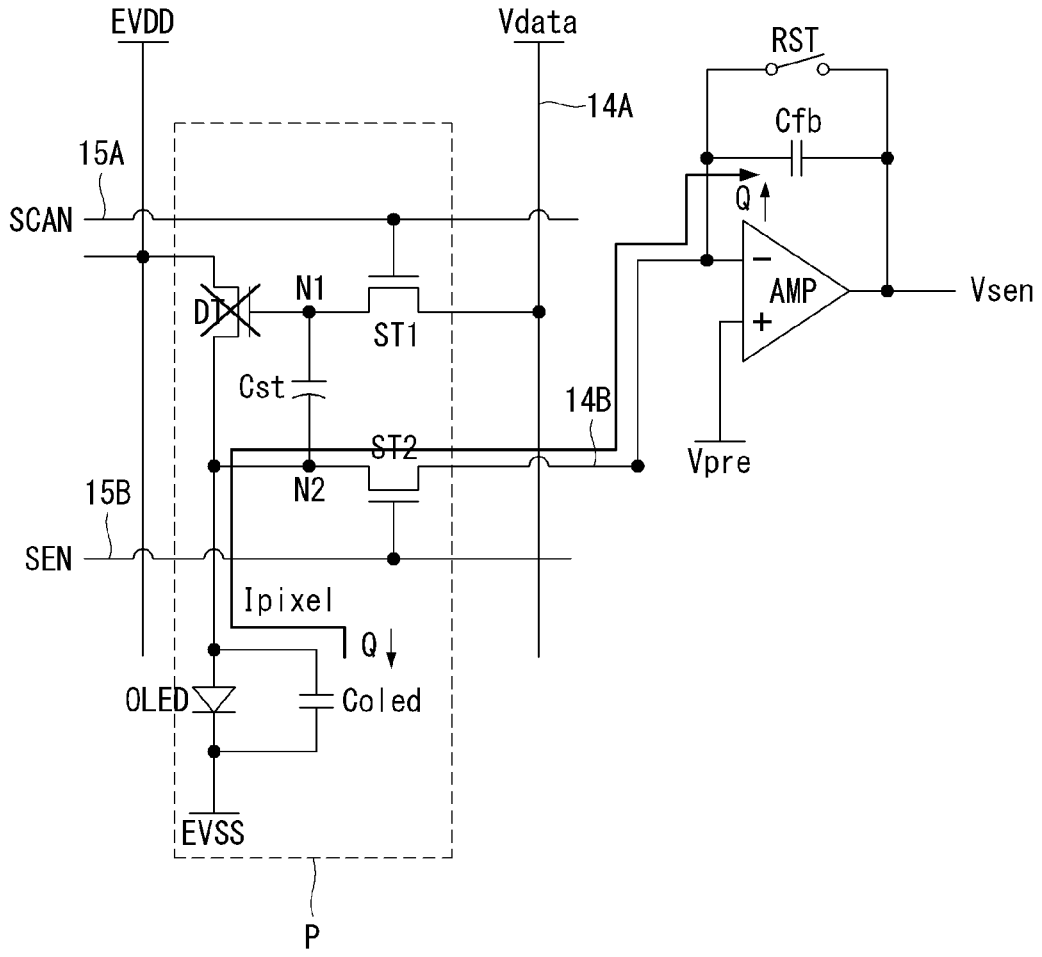
Figure 11:
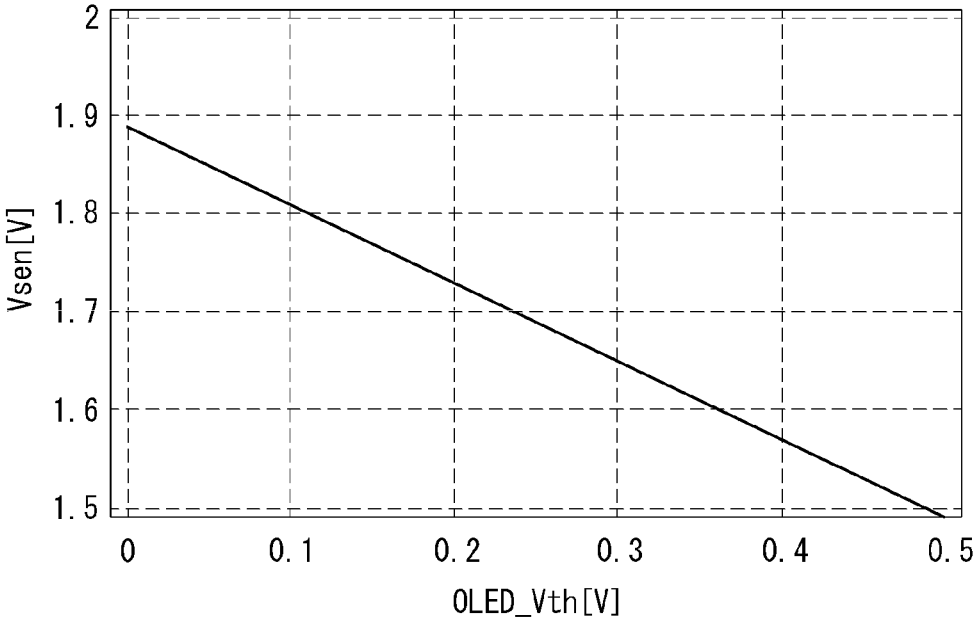
FIG. 11 is a graph showing an example relationship between a threshold voltage of an OLED and a sensing voltage output from a current integrator.
Figure 12:
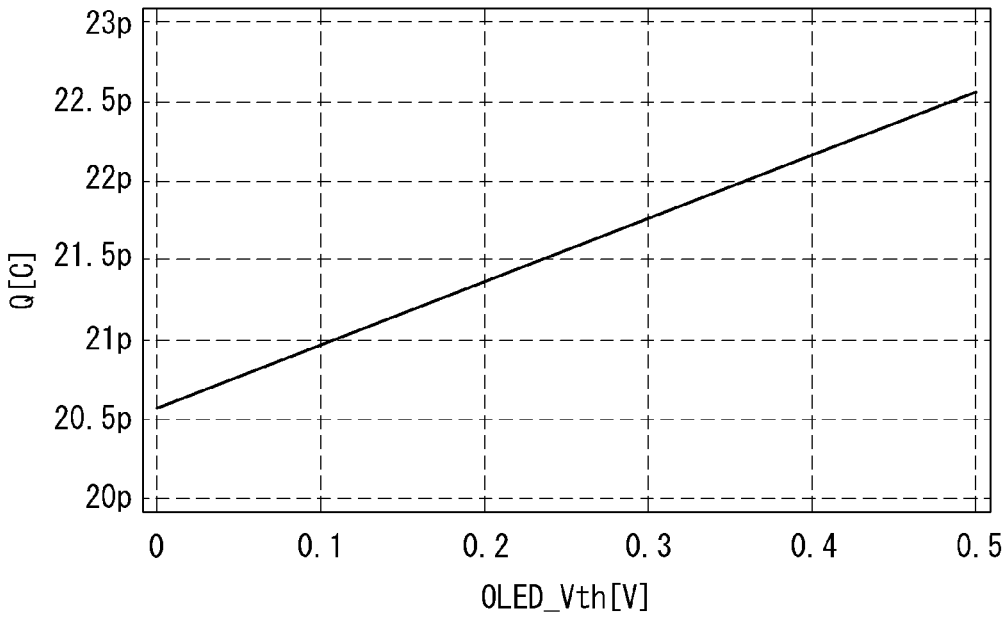
FIG. 12 is a graph showing an example relationship between a threshold voltage of an OLED and an amount of carriers charged to a parasitic capacitor of an OLED.

FIG. 7 shows an example degradation sensing timing of the OLED based on the connection structure shown in FIG. 5. FIGS. 8 and 9 show example degradation sensing timings of the OLED based on the connection structure shown in FIG. 6. FIGS. 10A to 10C show an example operation state of the pixel and the current integrator in a data writing period, a boosting period, and a sensing period, which may be commonly included in FIGS. 7 to 9. FIG. 11 is a graph showing an example relationship between the threshold voltage of the OLED and the sensing voltage output from the current integrator. FIG. 12 is a graph showing an example relationship between the threshold voltage of the OLED and an amount of carriers charged to the parasitic capacitor of the OLED.

As shown by example in FIGS. 7 to 12, a sensing process for sensing an amount of carriers charged to the OLED parasitic capacitor Coled of the pixel P may include a data writing period Twrt, a boosting period Tbst, and a sensing period Tsen. The sensing process may further include a sampling period Tsam following the sensing period Tsen. An example of the sensing process is described below with reference to FIGS. 10A to 10C.

As shown by example in FIGS. 7, 8, and 10A, in the data writing period Twrt, the amplifier AMP may operate as a unit gain buffer having a gain '1' due to turn-on of the reset switch RST, and all of the input terminals (−) and (+) and the output terminal of the amplifier AMP and the sensing line 14B may be initialized to the reference voltage Vpre. In the data writing period Twrt, a sensing data voltage Vdata_SEN may be applied to the data line 14A through the DAC of the data driver IC SDIC.

The sensing data voltage Vdata_SEN on the data line 14A may be applied to the first node N1 via the turned-on first switch TFT ST1, and the reference voltage Vpre on the sensing line 14B may be applied to the second node N2 via the turned-on second switch TFT ST2. Hence, a drain-to-source current Ids (e.g., the driving current of the OLED) corresponding to a voltage difference {(Vdata_SEN)−Vpre} between the first node N1 and the second node N2 may flow in the driving TFT DT. However, because the amplifier AMP may continuously operate as the unit gain buffer, a voltage of the output terminal of the amplifier AMP may be maintained at the reference voltage Vpre in the data writing period Twrt.

As shown by example in FIGS. 7, 8, and 10B, in the boosting period Tbst, the first and second switch TFTs ST1 and ST2 may be turned off. Hence, the voltage of the second node N2, e.g., an anode voltage Vanode of the OLED increases due to the drain-to-source current Ids of the driving TFT DT. At this time, the anode voltage Vanode of the OLED by the boosting may vary depending on a degradation degree of the OLED. For example, in a voltage change waveform shown in FIGS. 7 and 8, a degradation degree of the anode voltage Vanode indicated by the dotted line may be relatively more than a degradation degree of the anode voltage Vanode indicated by the solid line. In this instance, an amount (Q=Coled*Vanode) of carriers charged to the OLED parasitic capacitor Coled may vary depending on the degradation degree of the OLED. Because the amplifier AMP may continuously operate as the unit gain buffer, a voltage of the output terminal of the amplifier AMP may be maintained at the reference voltage Vpre in the boosting period Tbst.

As shown in FIGS. 7, 8, and 10C, in the sensing period Tsen, the first and second switch TFTs ST1 and ST2 may be turned on, and the reset switch RST may be turned off. The carriers charged to the OLED parasitic capacitor Coled may be stored in the integrating capacitor Cfb of the current integrator CI through the second switch TFT ST2 and may be sensed. In this instance, a black gray data voltage Vdata_black may be applied to the data line 14A through the DAC of the data driver IC SDIC, and the driving TFT DT may be turned off by the black gray data voltage Vdata_black applied through the first switch TFT ST1. Hence, the sensing value may be prevented from being distorted by the current flowing in the driving TFT DT.

As the sensing time passes (e.g., as an amount Ipixel of accumulated current increases), a voltage difference between both terminals of the integrating capacitor Cfb increases due to carriers entering the inverting input terminal (−) of the amplifier AMP in the sensing period Tsen.

However, the inverting input terminal (−) and the non-inverting input terminal (+) of the amplifier AMP may be short-circuited through virtual ground because of the characteristic of the amplifier AMP and may have a voltage difference of zero. Therefore, the voltage of the inverting input terminal (−) of the amplifier AMP may be maintained at the reference voltage Vpre irrespective of an increase in the voltage difference between both terminals of the integrating capacitor Cfb in the sensing period Tsen. Instead, the voltage of the output terminal of the amplifier AMP corresponding to the voltage difference between both terminals of the integrating capacitor Cfb may be reduced. Because of such a principle, carriers entering through the sensing line 14B may be converted into an integral value, e.g., the sensing voltage Vsen through the integrating capacitor Cfb in the sensing period Tsen. In this instance, the sensing voltage Vsen may be output as a value less than the reference voltage Vpre. This is because of the input and output characteristics of the current integrator CI.

As shown in FIG. 12, an amount Q of carriers charged to the OLED parasitic capacitor Coled may be proportional to a threshold voltage OLED_Vth of the OLED. For example, as the threshold voltage OLED_Vth of the OLED increases depending on the degradation of the OLED, the amount Q of carriers charged to the OLED parasitic capacitor Coled increases. Further, as shown in FIG. 11, the sensing voltage Vsen output to the current integrator CI may be inversely proportional to the threshold voltage OLED_Vth of the OLED because of the input and output characteristics of the current integrator CI. For example, the degradation degree of the OLED increases, the sensing voltage Vsen output to the current integrator CI may decrease.

In the sampling period Tsam shown in FIGS. 7 and 8, the sensing voltage Vsen may be stored in the sampling capacitor Cs (see, e.g., FIGS. 5 and 6) via the sampling switch SAM. In the sampling period Tsam, when the holding switch HOLD is turned on, the sensing voltage Vsen stored in the sampling capacitor Cs may be input to the ADC via the holding switch HOLD. The sensing voltage Vsen may be converted into a digital sensing value through the ADC, and then the digital sensing value may be transmitted to the timing controller 11. The timing controller 11 may apply the digital sensing value to a previously stored compensation algorithm and obtain a degradation deviation of the OLED and compensation data for compensating for the degradation deviation. The compensation algorithm may be implemented as a lookup table or a calculation logic.

As shown in FIG. 9, the sensing process according to embodiments of the invention may further include a discharge period Tdis positioned between the boosting period Tbst and the sensing period Tsen. The discharge period Tdis may be implemented only when the scan control signal SCAN and the sensing control signal SEN are differently configured.

As shown in FIG. 9, in the discharge period Tdis, the black gray data voltage Vdata_black may be applied to the data line 14A through the DAC of the data driver IC SDIC, and the driving TFT DT may be turned off by the black gray data voltage Vdata_black applied through the first switch TFT ST1. Hence, an amount of carriers accumulated in the OLED parasitic capacitor Coled in the boosting period Tbst may be discharged to the threshold voltage OLED_Vth of the OLED in the discharge period Tdis.

In FIGS. 7 and 8, the amount of carriers accumulated in the OLED parasitic capacitor Coled may vary depending on the gray level (corresponding to the gate-to-source voltage Vgs of the driving TFT DT determined during the data writing period), and the sensing voltage Vsen may have different values at the gray levels. In this instance, a reference value, which determines the degradation or the non-degradation, may have to be differently set at the gray levels. On the other hand, in FIG. 9, because the carriers accumulated in the OLED parasitic capacitor Coled may be reduced to the threshold voltage OLED_Vth of the OLED during the discharge period Tdis, the value of the sensing voltage Vsen at each gray level may not vary. Thus, in FIG. 9, because the reference value for determining the degradation or the non-degradation may not need to be differently set at the gray levels, only one reference value may be used. Hence, a process for preparing the compensation may be simplified.

A capacitance of the integrating capacitor Cfb included in the sensing unit according to embodiments of the invention may be one-several hundredths of a capacitance of a parasitic capacitor existing in the sensing line. Therefore, the time it takes to lead in the current at a voltage level capable of being sensed in the current sensing method according to embodiments of the invention may be greatly reduced as compared to the related art current sensing method. Further, a resistance of the integrating capacitor Cfb included in the sensing unit according to embodiments of the invention may not vary depending on a display load, unlike the parasitic capacitor existing in the sensing line. Therefore, an accurate sensing value may be obtained. As described above, embodiments of the invention may implement the low current and high-speed sensing through the current sensing method using the current integrator, thereby reducing the sensing time.

Figure 13:
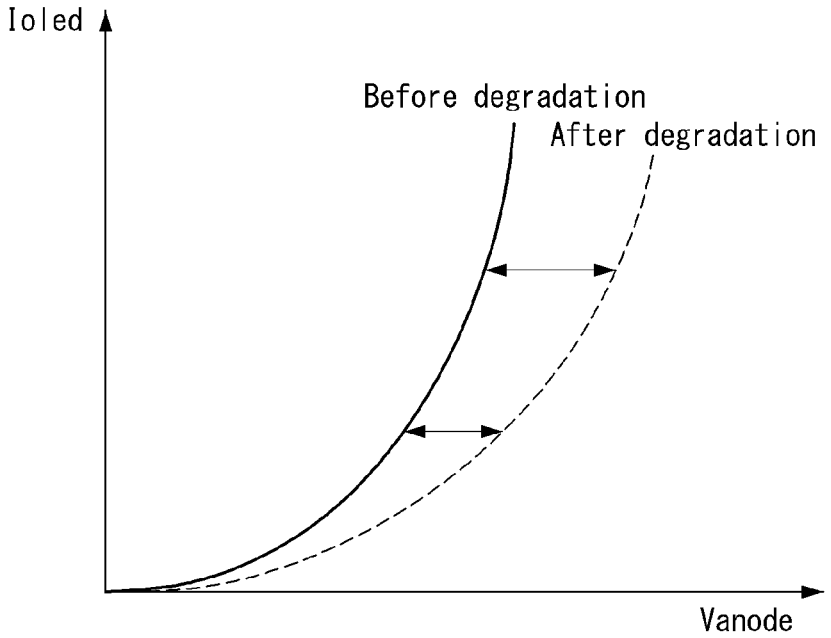
FIG. 13 shows that a graph indicating an example relationship between an anode voltage of an OLED and a driving current of the OLED is shifted depending on degradation of the OLED.

FIG. 13 shows that a graph indicating an example relationship between an anode voltage of the OLED and a driving current of the OLED may be shifted depending on the degradation of the OLED. FIGS. 14A and 14B show that a difference between the sensing voltages before and after the degradation of the OLED may vary depending on a magnitude of the driving current of the OLED.

As shown in FIG. 13, as the driving time is accumulated, the OLED anode voltage Vanode corresponding to the same OLED driving current Ioled after the degradation of the OLED may be greater than that before the degradation of the OLED.

As shown in FIGS. 14A and 14B, an increase degree of the OLED anode voltage Vanode may be proportional to a magnitude of the OLED driving current Ioled. In FIGS. 14A and 14B, the solid line denotes the OLED anode voltage Vanode before the degradation of the OLED, and the dotted line denotes the OLED anode voltage Vanode after the degradation of the OLED. As shown in FIGS. 14A and 14B, when at least two sensing operations are performed on each pixel while changing the magnitude of the OLED driving current Ioled, a degradation tendency of the OLED included in the corresponding pixel may be sufficiently understood.

[Embodiment of a Current Sensing Method Using a Current Comparator]

FIG. 15 shows an example connection structure between one pixel applied to external compensation of the current sensing method and a sensing unit including a current comparator.

As shown in FIG. 15, configuration of the pixel P may be substantially the same as configuration of the pixel P shown in FIG. 6. However, sensing unit SU#k connected to the pixel P may be implemented as a current comparator, where k is a positive integer.

The current comparator may receive current information Ipixel of the pixel P through the sensing line 14B, may compare the current information Ipixel of the pixel P with an internal reference current Iref, and may transmit the result of a comparison, as sensing information for deciding the degradation of the OLED, to the timing controller 11.

The current comparator may include an amplifier AMP including an inverting input terminal (−) which may be connected to the sensing line 14B through the sensing channel CH and may receive the current information Ipixel of the pixel P (e.g., carriers charged to the OLED parasitic capacitor Coled of the pixel P) from the sensing line 14B, a non-inverting input terminal (+) receiving the reference voltage Vpre, and an output terminal; a first switch SW1 connected between the inverting input terminal (−) and the output terminal of the amplifier AMP; a comparator connected to the output terminal of the amplifier AMP; a second switch SW2 connected between a reference current source IREF outputting the reference current Iref and the inverting input terminal (−) of the amplifier AMP; and a third switch SW3 connected between the sensing channel CH and the inverting input terminal (−) of the amplifier AMP.

The comparator may include a first node which may be set to a first voltage of a fixed level depending on the reference current Iref, a second node which may be set to a second voltage of a variable level depending on the current information Ipixel of the pixel P, and an output unit which may compare the first voltage with the second voltage and output "0" or "1". The comparator may output "1" when the second voltage is greater than the first voltage. To the contrary, when the second voltage is less than the first voltage, the comparator may output "0". In embodiments disclosed herein, "1" may be information indicating that the OLED of the corresponding pixel was degraded, and "0" may be information indicating that the OLED of the corresponding pixel was not degraded.

In a reset period, the second switch SW2 may be turned on and may input the reference current Iref to the comparator through the amplifier AMP. The comparator may reset the first and second nodes to the first voltage by the reference current Iref.

In a data writing period, the amplifier AMP may operate as the unit gain buffer due to the turn-on of the first switch SW1, and the reference voltage Vpre may be applied to the sensing line 14B due to the turn-on of the third switch SW3. An operation of the pixel in the data writing period and a boosting period may be substantially the same as that in FIG. 8.

In a sensing period, when the first switch SW1 is turned off, the current information Ipixel of the pixel P input through the sensing line 14B may be applied to the second node of the comparator. As a result, the voltage of the second node may change from the first voltage to the second voltage.

In a comparison period, the comparator may compare the first and second voltages and output "0" or "1".

The current sensing method using the current comparator according to embodiments of the invention greatly reduce the time required to lead in the current at a voltage level capable of being sensed as compared to the related art voltage sensing method, and thus may be effective in the low current and high-speed sensing.

Figures 16, 17:
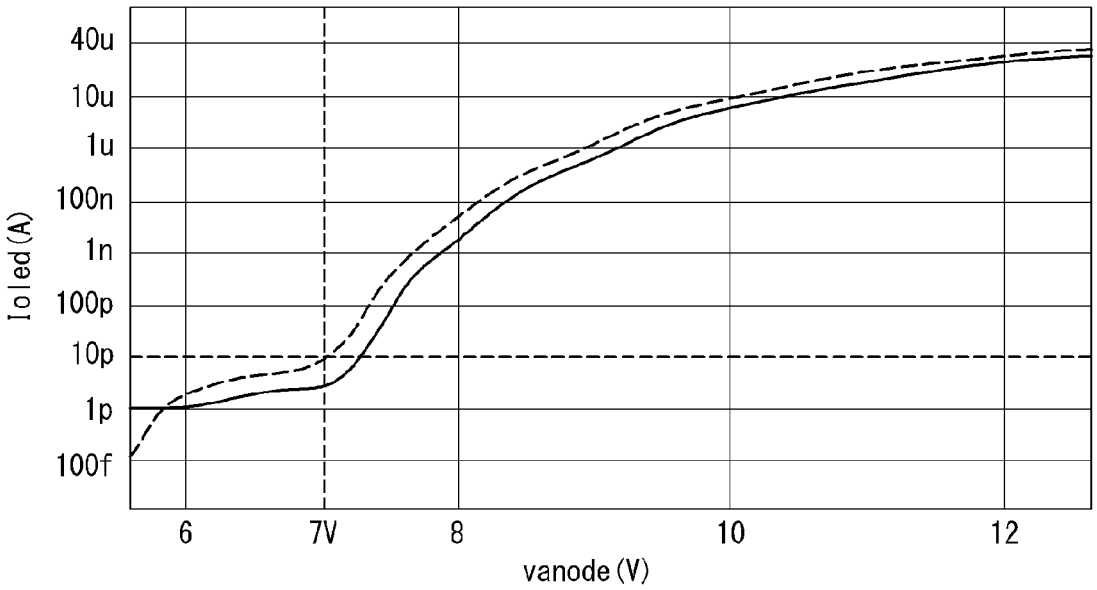
FIGS. 16 to 18 illustrate an example sensing method in a structure in which at least two pixels share the same sensing line with one another, as shown by example in FIG. 2B.
Figure 18:
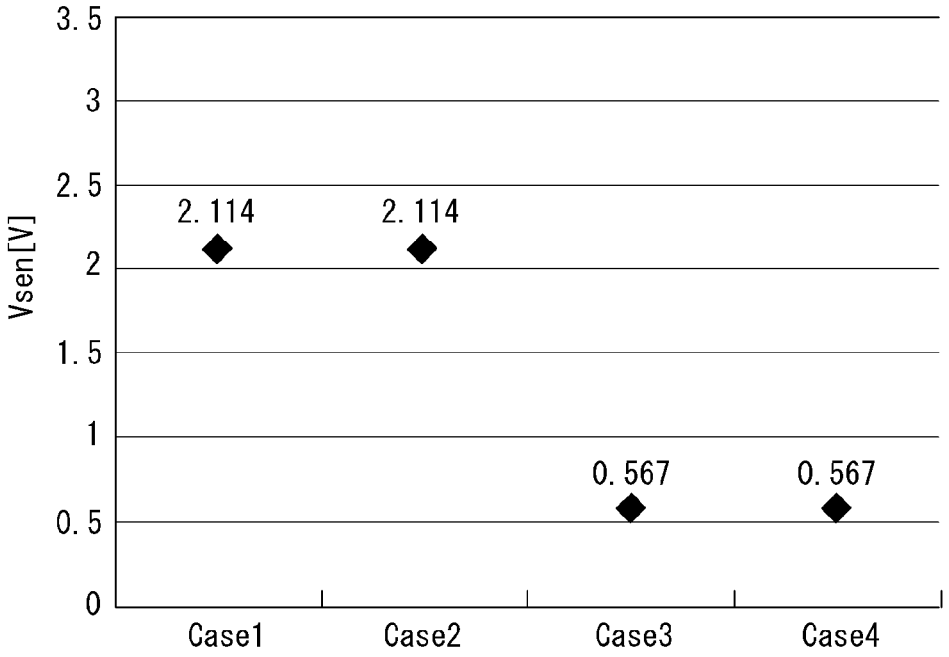

FIGS. 16 to 18 illustrate an example sensing method in a sensing line sharing structure, in which at least two pixels (pixels of a sharing group) share the same sensing line with one another as shown, for example, in FIG. 2B.

As shown in FIG. 16, the OLED may have a predetermined threshold voltage (for example, 7V) and may be turned on only when the anode voltage Vanode of the OLED is greater than the threshold voltage of the OLED. In a sensing line sharing structure as shown in FIG. 2B, the pixels may have to be individually sensed, so as to increase the sensing accuracy. In this instance, the OLEDs of other pixels of a sharing group except a sensing target pixel belonging to the sharing group may have to be turned off As shown in FIG. 17, if the sensing target pixel is a blue (B) pixel, embodiments of the invention may apply the reference voltage Vpre less than the OLED threshold voltage to all of the R, W, G, and B pixels belonging to a sharing group in the data writing period and may apply the sensing data voltage only to the B pixel in a state where all of the R, W, G, and B pixels of the sharing group are turned off, in the data writing period, thereby performing the above-described sensing process. Hence, because all of the R, W, and G pixels maintain the turn-off state during the sensing process of the B pixel, a sensing value of the B pixel may not be affected by the R, W, and G pixels.

For example, as can be seen from simulation results of FIGS. 17 and 18, in 'Case1' and 'Case2', where changes in the OLED threshold voltage of the B pixel are 0V, the sensing voltage Vsen of the B pixel may have the same value (for example, 2.114V) irrespective of changes (from 0V to +2V, for example) in the OLED threshold voltages of the R, W, and G pixels. Further, in 'Case3' and 'Case4' where changes in the OLED threshold voltage of the B pixel are +2V, the sensing voltage Vsen of the B pixel has the same value (for example, 0.567V) irrespective of changes (from 0V to +2V, for example) in the OLED threshold voltages of the R, W, and G pixels.

As described above, embodiments of the invention reduce the sensing time through the low current and high-speed sensing and increase the sensing accuracy through the current sensing method. As an example of the current sensing method, embodiments of the invention install at least one sensing unit in the data driving circuit and sense an amount of carriers accumulated in the parasitic capacitor of the OLED of the sensing target pixel through the sensing unit when the driving current flows in the OLED of the sensing target pixel. The sensing unit according to embodiments of the invention may be implemented as the current integrator or the current comparator. The current sensing method using the sensing unit may greatly reduce the time required to lead in the current at the voltage level capable of being sensed as compared to the related art voltage sensing method, and thus may be effective in the low current and high-speed sensing.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display, comprising:

a display panel including a plurality of pixels, each of the plurality of pixels including an organic light emitting diode (OLED) and a driving thin film transistor (TFT) to control an emission amount of the OLED, the plurality of pixels connected to respective sensing lines; and at least one sensing unit connected to a corresponding one of the pixels through the respective sensing line, wherein the at least one sensing unit is configured to sense an amount of carriers accumulated in a parasitic capacitor of the OLED of the corresponding one of the pixels when a driving current flows in the OLED, the at least one sensing unit thereby sensing a degradation of the OLED, wherein the display is configured to include a sensing process for sensing the amount of carriers of the parasitic capacitor, the sensing process including a data writing period, a boosting period, and a sensing period, wherein in the data writing period, a gate-to-source voltage of the driving TFT is set to provide the driving current flowing in the OLED, wherein in the boosting period, an anode voltage of the OLED is boosted by the driving current flowing through the OLED and is stored in the parasitic capacitor of the OLED, wherein in the sensing period, the driving TFT is set to turn off the driving current flowing through the OLED, and the amount of carriers accumulated in the parasitic capacitor of the OLED is sensed by the sensing unit.

2. The organic light emitting display of claim 1, wherein the at least one sensing unit includes one of a current integrator and a current comparator.

3. The organic light emitting display of claim 1, wherein the sensing process further includes a discharge period positioned in time between the boosting period and the sensing period, wherein in the discharge period, the amount of carriers accumulated in the parasitic capacitor of the OLED is discharged to a threshold voltage of the OLED.

4. The organic light emitting display of claim 1, wherein each pixel includes:

a first switch TFT connected between a data line and a gate electrode of the driving TFT and configured to turn on in response to a scan control signal;

a second switch TFT connected between the sensing line and a source electrode of the driving TFT and configured to turn on in response to a sensing control signal; and a storage capacitor connected between the gate electrode and the source electrode of the driving TFT.

5. The organic light emitting display of claim 4, wherein the scan control signal and the sensing control signal are the same.

6. The organic light emitting display of claim 1, wherein the sensing lines are independently connected to horizontally adjacent pixels, respectively.

7. The organic light emitting display of claim 1, wherein the sensing lines are commonly connected to at least two horizontally adjacent pixels.

8. A method of forming an organic light emitting display, comprising:

forming a display panel including a plurality of pixels, each of the plurality of pixels including an organic light emitting diode (OLED) and a driving thin film transistor (TFT) to control an emission amount of the OLED, the plurality of pixels connected to respective sensing lines; and forming at least one sensing unit connected to a corresponding one of the pixels through the respective sensing line, wherein the at least one sensing unit is configured to sense an amount of carriers accumulated in a parasitic capacitor of the OLED of the corresponding one of the pixels when a driving current flows in the OLED the at least one sensing unit thereby sensing a degradation of the OLED, wherein the display is configured to include a sensing process for sensing the amount of carriers of the parasitic capacitor, the sensing process including a data writing period, a boosting period, and a sensing period, wherein in the data writing period, a gate-to-source voltage of the driving TFT is set for the driving current, wherein in the boosting period, an anode voltage of the OLED is boosted by the driving current flowing through the OLED and is stored in the parasitic capacitor of the OLED, wherein in the sensing period, the driving TFT is set to turn off the driving current flowing through the OLED, and the amount of carriers accumulated in the parasitic capacitor of the OLED is sensed by the sensing unit.

9. The method of claim 8, wherein forming the at least one sensing unit includes forming one of a current integrator and a current comparator.

10. The method of claim 8, wherein the sensing process further includes a discharge period positioned in time between the boosting period and the sensing period, wherein in the discharge period, the amount of carriers accumulated in the parasitic capacitor of the OLED is discharged to a threshold voltage of the OLED.

11. The method of claim 8, wherein each pixel includes:

a first switch TFT connected between a data line and a gate electrode of the driving TFT and configured to turn on in response to a scan control signal;

a second switch TFT connected between the sensing line and a source electrode of the driving TFT and configured to turn on in response to a sensing control signal; and a storage capacitor connected between the gate electrode and the source electrode of the driving TFT.

12. The method of claim 11, wherein the scan control signal and the sensing control signal are the same.

13. The method of claim 8, wherein the sensing lines are independently connected to horizontally adjacent pixels, respectively.

14. The method of claim 8, wherein the sensing lines are commonly connected to at least two horizontally adjacent pixels.

* * * * *